US007045716B2

(12) United States Patent
Granheim

(10) Patent No.: US 7,045,716 B2
(45) Date of Patent: May 16, 2006

(54) ELECTRICAL CABLE

(75) Inventor: Ivar Granheim, Lorenskog (NO)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/846,826

(22) Filed: May 13, 2004

(65) Prior Publication Data

US 2004/0262026 A1 Dec. 30, 2004

(30) Foreign Application Priority Data

May 15, 2003 (NO) ..... 20032202

(51) Int. Cl.
*H01B 7/00* (2006.01)

(52) U.S. Cl. ..... 174/102 SC; 174/110 R

(58) Field of Classification Search ..... 174/102 SC, 174/103, 105 R, 106 R, 106 SC, 110 R
See application file for complete search history.

(56) References Cited

U.S. PATENT DOCUMENTS

| | | | | |
|---|---|---|---|---|
| 2,981,788 | A * | 4/1961 | Bunish | 174/115 |
| 5,739,471 | A * | 4/1998 | Burisch | 174/102 R |
| 2004/0194996 | A1 * | 10/2004 | Ysbrand | 174/102 SC |
| 2005/0006126 | A1 * | 1/2005 | Aisenbrey | 174/68.1 |

* cited by examiner

*Primary Examiner*—Chau N. Nguyen
(74) *Attorney, Agent, or Firm*—Sofer & Haroun, LLP

(57) ABSTRACT

The present invention relates to the field of electrical cables to be installed in materials such as concrete or other cement based materials and more particularly but not limitatively to heating cables such as floor heating cables. More precisely, the invention provides an electrical cable comprising an outer protective sheath and at least a conductor within said outer protective sheath, said electrical cable being lead-free and characterized in that it comprises at least an element made of a polymer compound with a sufficiently high density in order to provide an overall specific density of said cable of at least 4.5 g/cm$^3$.

13 Claims, 2 Drawing Sheets

ELECTRICAL CABLE

RELATED APPLICATION

This application is related to and claims the benefit of priority from Norwegian Patent Application No. 2003 2202, filed on May 15, 2004, the entirety of which is incorporated herein by reference.

FIELD OF THE INVENTION

The present invention relates to the field of electrical cables to be installed in materials such as concrete or other cement based materials and more particularly but not limitatively to heating cables such as floor heating cables.

BACKGROUND OF THE INVENTION

It is well known to provide house installation electrical cables to be installed in concrete or cement based materials. Such a cable may be for example a heating cable to be installed in floors and walls for the general heating of buildings, and in outdoor pavements, for snow melting purposes. Such a heating cable comprises a resistance conductor with a relatively high positive temperature coefficient (PTC), the resistance conductor becoming warm when sufficient current flows through it. Such a cable may also be a power or telecommunication cable.

One problem is to prevent a house installation electrical cable, intended to be installed in concrete or similar cement based materials in floors, to float up to the surface of the wet concrete during installation, which limits the need to attach the cable to the existing floor surface A known solution to this problem is to provide an electrical cable having an inner sheath made of lead. Lead is indeed a heavy weight material avoiding such heating cable to float up to the surface and limits the need to attach it to the existing floor This solution raises some difficult problems because of environmental reasons. At some levels of human exposure to lead, there is indeed a risk of damage for human organ systems and biochemical processes. Therefore, introduction of lead into the human environment has decreased in recent years, largely due to public health campaigns.

OBJECT AND SUMMARY OF THE INVENTION

One object of the present invention is to provide an electrical cable intended to be installed in a material such as concrete or other cement based materials without floating up to the surface of the material during installation and being more environmental sustainable than electrical cable comprising lead.

More precisely, the invention provides an electrical cable comprising an outer protective sheath and at least a conductor within said outer protective sheath, said electrical cable being lead-free and characterized in that it comprises at least an element made of a polymer compound with a sufficiently high density in order to provide an overall specific density of said cable of at least 4.5 g/cm$^3$.

Thus, by use of this electrical cable, the element made of a polymer compound allows to get an overall density which is much higher than the density of wet concrete approximately equal to 2.3 g/cm$^3$. Said polymer compound can be for instance a high density polymer compound such as a polymer matrix based on polyethylene filled with copper powder, the nominal density of such a compound being about 5 g/cm$^3$. Moreover, experimental tests have shown that the overall density of the electrical cable must be at least equal to 4.5 g/cm$^3$ in order to get an electrical cable weight sufficient to secure the installation of said cable without having a strong tendancy of floating up to the surface of the wet concrete. Such an electrical cable is more environmental sustainable than electrical cable comprising pure metallic lead.

Advantageously, said conductor is a resistance conductor. In such an embodiment, said electrical cable is a heating cable.

Furthermore, said electrical cable comprises an insulating layer surrounding said conductor.

Said insulating layer can be made for instance of a well-stabilised heat resistant material such as cross-linked polyethylene XLPE. This insulating layer may also be based on fluoropolymers such FEP (Fluorinated Ethylene Propylene).

Advantageously, said polymer compound comprises a polymer matrix filled with filling means.

Advantageously, said filling means include powder or fibres.

Advantageously, said filling means are made of metal and/or metal-oxide and/or metal-salt.

Advantageously, said filling means are a mixture comprising copper and/or steel and/or tungsten.

Advantageously, said polymer matrix is made of a material chosen among said following materials: elastomer, polyurethane, polyolefin, co-polymer of polyolefin, plasticised polyvinyl chloride, thermoplastic elastomer.

In one embodiment, said element made of a polymer compound comprises at least one polymer based string extending in parallel with said conductor.

In a second embodiment, said element made of a polymer compound comprises a polymer-based layer surrounded by said outer protective sheath.

In a third embodiment, said element made of a polymer compound comprises a polymer-based filler.

Furthermore, said electrical cable comprises:

an earth screen, a plurality of earth wires in contact with said earth screen.

Said earth screen can be for instance an Al tape in contact with Cu earth wires.

BRIEF DESCRIPTION OF THE DRAWINGS

Other characteristics and advantages of the invention will appear on reading the following description of embodiments of the invention, given by way of example and with reference to the accompanying drawing, in which.

DETAILED DESCRIPTION

Figure 1:
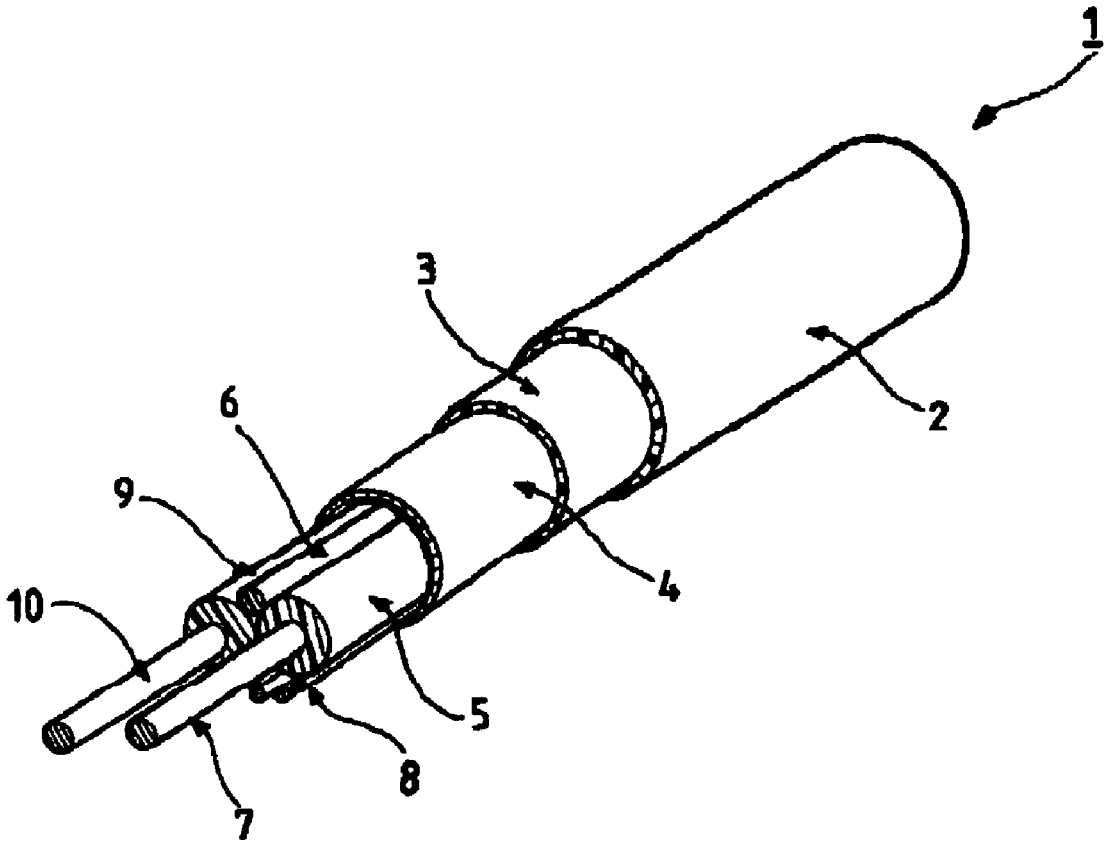
FIG. 1 shows schematically a perspective view of an electrical cable according to a first embodiment of the invention.

FIG. 1 shows an electrical cable that is a heating cable 1 according to a first embodiment of the invention.

The heating cable 1 comprises starting from outside to inside:

- an outer sheath 2 made of a PVC (polyvinyl chloride) based compound,
- a high-density polymer based layer 3 according to the invention, an aluminium tape 4 acting as an earth screen, a plurality of copper earth wires 8 in contact with the Al tape 4 in order to form the connection to earth in an electrical distribution system, a resistance conductor 7 surrounded by a concentrical insulation layer 5 made of cross-linked polyethylene XLPE, a return conductor 10 surrounded by a concentrical insulation layer 9 made of cross-linked polyethylene XLPE, a high-density polymer based string 6 extending in parallel with resistance and return conductors 7 and 10, according to the invention.

The outer sheath 2 is mainly used to give mechanical protection to the internal components in the cable.

The high-density polymer based layer 3 can be sticked to the outer sheath 2.

The resistance conductor 7 is a conductor with a relatively high positive temperature coefficient (PTC), the resistance conductor becoming warm when sufficient current flows through it.

The high-density polymer compound used in the layer 3 and the string 6 comprises for instance a polymer matrix filled with metallic or metal-oxide filling means such as powder or fibres.

The polymer matrix can be based on the following materials:

Thermoplastic Polyurethane (PUR),

Polyolefin like Polyethylene (PE) and Polypropylene (PP),

Co-polymer of Ethylene, like Ethylene-Vinyl-Acetate (EVA), Ethylene-Ethyl-Acrylate (EEA), Ethylene-Butyl-Acrylate (EBA), Polyester-elastomer, Polyamide-elastomer, Elastomer (rubber), Polychloroprene (PCP), Chlorinated PE (CPE), Chlorosulfonated PE (CSP), Polyolefin based elastomer, Plasticised PVC compound.

Said metallic or metal-oxide filling means can be based on (or a mixture of):

Copper Cu,

Tungsten W,

Steel.

In order to illustrate the embodiment, the high-density polymer compound can be for instance a polyethylene based matrix material filled with copper and tungsten with a total weight having the following recipe:

47.2% of the total weight made of polyethylene,

50% of the total weight made of copper, 2.8% of the total weight made of tungsten.

Such a recipe gives a polymer compound with a density D of 5.5 g/cm$^3$ based on the following calculation:

$$D = ((\text{weight-\% PE} \times \text{density of PE}) + (\text{weight-\% Cu} \times \text{density of Cu}) + (\text{weight-\% W} \times \text{density of W}))/100, \text{ with:}$$

Density of PE=0.92 g/cm$^3$,

Density of Cu=8.96 g/cm$^3$,

Density of W=19.3 g/cm$^3$.

The following dimensions and densities given in table 1 below give an embodiment of a heating cable 1 having an overall specific density of 5 g/cm$^3$.

TABLE 1

| Heating cable components | Transverse cross sectional area | Density |
|---|---|---|
| Outer sheath 2 | 4.4988 mm$^2$ | 1.35 g/cm$^3$ |
| High-density polymer based layer 3 | 11.9883 mm$^2$ | D = 5.5 g/cm$^3$ |
| Tape 4 | 2.7 mm$^2$ | 2.7 g/cm$^3$ |
| Copper earth wire 8 | 0.14 mm$^2$ | 8.96 g/cm$^3$ |
| Resistance conductor 7 | 0.5809 mm$^2$ | 8.9 g/cm$^3$ |
| Insulation layer 5 | 4.8506 mm$^2$ | 0.92 g/cm$^3$ |
| Return conductor 10 | 1.0028 mm$^2$ | 8.96 g/cm$^3$ |
| Insulation layer 9 | 4.8506 mm$^2$ | 0.92 g/cm$^3$ |
| High-density polymer based string 6 | 0.7853 mm$^2$ | D = 5.5 g/cm$^3$ |

The heating cable 1 comprises seven copper earth wires 8.

The overall cross sectional area of the heating cable 1 is equal to 23,1221 mm$^2$.

Dimensions and densities given above allow to get an overall specific density of the heating cable 1 of 5 g/cm$^3$ without adding lead to said heating cable.

Such a heating cable specific density is high enough to avoid the "float-up" effect in wet concrete having a density approximately equal to 2.3 g/cm$^3$ or similar cement-based masses.

Figure 2:
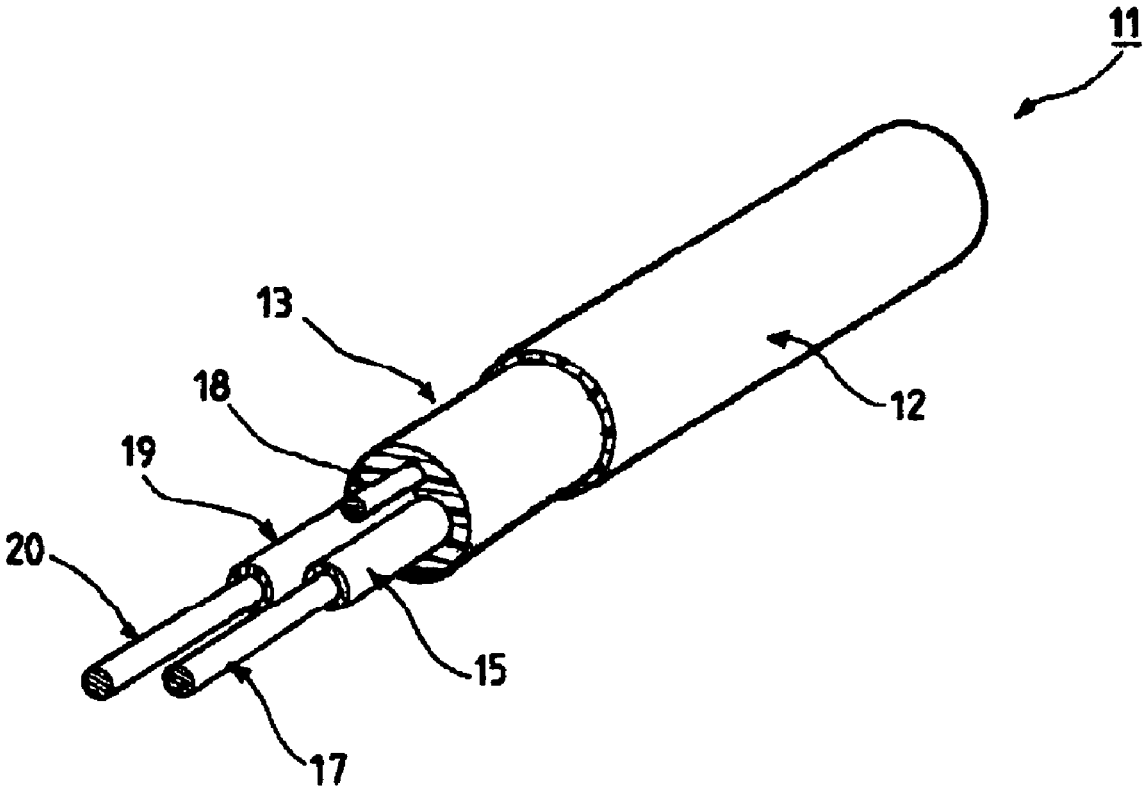
FIG. 2 shows schematically a perspective view of an electrical cable according to a second embodiment of the invention

The element made of a polymer compound with a sufficiently high density has been described for instance as comprising a high density string and a high density layer but it is also within the scope of the invention to consider other elements with various shapes such as a polymer compound filler 13 as shown in FIG. 2.

FIG. 2 shows an electrical cable that is a heating cable 11 according to a second embodiment of the invention.

The invention claimed is:

1. Electrical cable for installation within building materials including concrete and cement based materials having an outer protective sheath and at least a conductor within said outer protective sheath, said electrical cable being lead-free and comprising:

at least an element made of a polymer compound with a sufficiently high density in order to provide an overall specific density of said cable of at least 4.5 g/cm$^3$, such that said electrical cable is sufficiently dense that it remains submerged under the surface of said building material while it is being installed.

2. Electrical cable according to claim 1 wherein said conductor is a resistance conductor.

3. Electrical cable according to claim 1 wherein said electrical cable comprises an insulating layer surrounding said conductor.

4. Electrical cable according to claim 1 wherein said polymer compound comprises a polymer matrix filled with filling means.

5. Electrical cable according to claim 4 wherein said filling means include powder or fibres.

6. Electrical cable according to claim 4 wherein said filling means are made of any one of metal, metal-oxide and metal-salt.

7. Electrical cable according to claim 4 wherein said filling means are a mixture comprising any one of copper, steel and tungsten.

8. Electrical cable according to claim 4 wherein said polymer matrix is made of a material chosen among said following materials: elastomer, polyurethane, polyolefin, co-polymer of polyolefin, plasticised polyvinyl chloride, thermoplastic elastomer.

9. Electrical cable according to claim 1 wherein said element made of a polymer compound comprises at least one polymer based string extending in parallel with said conductor.

10. Electrical cable according to claim 1 wherein said element made of a polymer compound comprises a polymer based layer surrounded by said outer protective sheath.

11. Electrical cable according to claim 1 wherein said element made of a polymer compound comprises a polymer-based filler.

12. Electrical cable according to claim 1 wherein said electrical cable further comprises:

an earth screen, a plurality of earth wires in contact with said earth screen.

13. Electrical cable for installation within building materials including concrete and cement based materials having an outer protective sheath and at least a conductor within said outer protective sheath, said electrical cable being lead-free and comprising:

an earth screen, a plurality of earth wires in contact with said earth screen, at least an element made of a polymer compound with a sufficiently high density in order to provide an overall specific density of said cable of at least 4.5 g/cm$^3$, such that said electrical cable is sufficiently dense that it remains submerged under the surface of said building material while it is being installed.

* * * * *